US009347121B2

(12) United States Patent
Forbes Jones et al.

(10) Patent No.: US 9,347,121 B2
(45) Date of Patent: May 24, 2016

(54) HIGH STRENGTH, CORROSION RESISTANT AUSTENITIC ALLOYS

(75) Inventors: Robin M. Forbes Jones, Charlotte, NC (US); C. Kevin Evans, Monroe, NC (US); Henry E. Lippard, Charlotte, NC (US); Adrian R. Mills, Sheffield (GB); John C. Riley, Sheffield (GB); John J. Dunn, Sarver, PA (US)

(73) Assignee: ATI PROPERTIES, INC., Albany, OR (US)

( * ) Notice: Subject to any disclaimer, the term of this patent is extended or adjusted under 35 U.S.C. 154(b) by 0 days.

(21) Appl. No.: 13/331,135

(22) Filed: Dec. 20, 2011

(65) Prior Publication Data

US 2013/0156628 A1 Jun. 20, 2013

(51) Int. Cl.

| | |
|---|---|
| ***C22C 38/00*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/52*** | (2006.01) |
| ***C22C 38/58*** | (2006.01) |
| ***C22C 38/02*** | (2006.01) |
| ***C22C 38/04*** | (2006.01) |

(52) U.S. Cl.

CPC ..... *C22C 38/001* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/52* (2013.01); *C22C 38/58* (2013.01)

(58) Field of Classification Search

CPC ..... C22C 38/42; C22C 38/44; C22C 38/46; C22C 38/48; C22C 38/50; C22C 38/52

USPC ..... 148/327; 420/44, 581, 586, 586.1

See application file for complete search history.

(56) References Cited

U.S. PATENT DOCUMENTS

| | | | | |
|---|---|---|---|---|
| 3,659,882 | A | 5/1972 | Souresny | |
| 4,184,484 | A | 1/1980 | Wright et al. | |
| 4,818,484 | A | 4/1989 | DeBold et al. | |
| 5,094,812 | A | 3/1992 | Dulmaine et al. | |
| 5,310,522 | A | 5/1994 | Culling | |
| 5,328,529 | A | 7/1994 | Cordea et al. | |
| 5,378,427 | A * | 1/1995 | Otsuka et al. | 420/586.1 |
| 5,494,636 | A | 2/1996 | Dupoiron et al. | |
| 6,454,879 | B1 | 9/2002 | Aigner et al. | |
| 6,764,647 | B2 | 7/2004 | Aigner et al. | |
| 6,918,967 | B2 | 7/2005 | Crum et al. | |
| 6,918,968 | B2 | 7/2005 | Semba et al. | |
| 7,531,129 | B2 | 5/2009 | Igarashi et al. | |
| 7,708,841 | B2 | 5/2010 | Saller et al. | |
| 2008/0000554 | A1 | 1/2008 | Yaguchi et al. | |
| 2008/0163957 | A1 | 7/2008 | Brady et al. | |
| 2010/0034689 | A1 * | 2/2010 | Hirata et al. | 420/41 |
| 2010/0170596 | A1 * | 7/2010 | Saller et al. | 148/566 |

FOREIGN PATENT DOCUMENTS

| | | | |
|---|---|---|---|
| EP | 1997921 | A2 | 12/2008 |
| JP | 2001-107196 | A | 4/2001 |
| WO | WO 99/23267 | A1 | 5/1999 |
| WO | WO 2007/126383 | A1 | 11/2007 |
| WO | WO 2009044796 | A1 * | 4/2009 |

OTHER PUBLICATIONS

Kodym et al., 5 Trace Elements in Steel—possibilities for influencing the smelting process; Kreitner, F. and K. Apfelmaier, 6 Effects of trace elements on the hot-forming ability of steels and nickel-based alloys, Spurenelemente in Stählen, Duseldorf, Verlag Stahleisen, Germany, Jan. 1, 1987, pp. 19-34.

Haynes International, Haynes HR®-120® alloy, May 1, 2008, 4 pages, Kokomo, Indiana, http://www.haynesintl.com/pdf/h3125.pdf.

Development of Ultrahigh Strength Austenitic Stainless Steels Alloyed with Nitrogen, a dissertation submitted to the Swiss Federal Institute of Technology in Zurich for the degree of Doctor of Technical Sciences, presented by Paolo Cobelli, Diss. ETH Nr. 15025, 2003, 124 pages.

Haynes International, Haynes® HR-120® alloy, H-3125F, Apr. 3, 2003, Kokomo, Indiana, pp. 1-25 and 27-28 as available at http://www.haynesintl.com/pdf/h3125.pdf.

Haynes International, Inc., Corrosion-Resistant Alloys and High-Temperature Alloys, Material Safety Data Sheet H2071-8, Aug. 11, 2009, 15 pages, Kokomo, Indiana, http://www.haynesintl.com/MSDS/H2071en.pdf.

* cited by examiner

*Primary Examiner* — Alexander Polyansky
(74) *Attorney, Agent, or Firm* — K&L Gates LLP

(57) ABSTRACT

An austenitic alloy may generally comprise, in weight percentages based on total alloy weight: up to 0.2 carbon; up to 20 manganese; 0.1 to 1.0 silicon; 14.0 to 28.0 chromium; 15.0 to 38.0 nickel; 2.0 to 9.0 molybdenum; 0.1 to 3.0 copper; 0.08 to 0.9 nitrogen; 0.1 to 5.0 tungsten; 0.5 to 5.0 cobalt; up to 1.0 titanium; up to 0.05 boron; up to 0.05 phosphorus; up to 0.05 sulfur; iron; and incidental impurities.

37 Claims, No Drawings

HIGH STRENGTH, CORROSION RESISTANT AUSTENITIC ALLOYS

BACKGROUND OF THE TECHNOLOGY

1. Field of the Technology

The present disclosure relates to high strength, corrosion resistant alloys. The alloys according to the present disclosure may find application in, for example and without limitation, the chemical industry, the mining industry, and the oil and gas industries.

2. Description of the Background of the Technology

Metal alloy parts used in chemical processing facilities may be in contact with highly corrosive and/or erosive compounds under demanding conditions. These conditions may subject metal alloy parts to high stresses and aggressively promote erosion and corrosion, for example. If it is necessary to replace damaged, worn, or corroded metallic parts, operations may need to be entirely suspended for a time at a chemical processing facility. Extending the useful service life of metal alloy parts in facilities used to process and convey chemicals may be achieved by improving the mechanical properties and/or corrosion resistance of the alloys, which may reduce costs associated with chemical processing.

Similarly, in oil and gas drilling operations, drill string components may degrade due to mechanical, chemical, and/or environmental conditions. The drill string components may be subject to impact, abrasion, friction, heat, wear, erosion, corrosion, and/or deposits. Conventional materials used for drill string components may suffer from one or more limitations. For example, conventional materials may lack sufficient mechanical properties (for example, yield strength, tensile strength, and/or fatigue strength), corrosion resistance (for example, pitting resistance and stress corrosion cracking), and non-magnetic properties. Also, conventional materials may limit the size and shape of the drill string components. These limitations may reduce the useful life of the components, complicating and increasing the cost of oil and gas drilling.

Therefore, it would be advantageous to provide novel alloys having improved corrosion resistance and/or mechanical properties.

SUMMARY

According to an aspect of the present disclosure, non-limiting embodiments of an austenitic alloy comprise, in weight percentages based on total alloy weight: up to 0.2 carbon; up to 20 manganese; 0.1 to 1.0 silicon; 14.0 to 28.0 chromium; 15.0 to 38.0 nickel; 2.0 to 9.0 molybdenum; 0.1 to 3.0 copper; 0.08 to 0.9 nitrogen; 0.1 to 5.0 tungsten; 0.5 to 5.0 cobalt; up to 1.0 titanium; up to 0.05 boron; up to 0.05 phosphorus; up to 0.05 sulfur; iron; and incidental impurities.

According to an additional aspect of the present disclosure, non-limiting embodiments of an austenitic alloy according to the present disclosure comprise, in weight percentages based on total alloy weight: up to 0.05 carbon; 2.0 to 8.0 manganese; 0.1 to 0.5 silicon; 19.0 to 25.0 chromium; 20.0 to 35.0 nickel; 3.0 to 6.5 molybdenum; 0.5 to 2.0 copper; 0.2 to 0.5 nitrogen; 0.3 to 2.5 tungsten; 1.0 to 3.5 cobalt; up to 0.6 titanium; a combined weight percentage of columbium and tantalum no greater than 0.3; up to 0.2 vanadium; up to 0.1 aluminum; up to 0.05 boron; up to 0.05 phosphorus; up to 0.05 sulfur; iron; and incidental impurities; wherein the steel has a $PREN_{16}$ value of at least 40, a critical pitting temperature of at least 45° C., and a coefficient of sensitivity to avoid precipitations value (CP) that is less than 750.

DETAILED DESCRIPTION OF CERTAIN NON-LIMITING EMBODIMENTS

It is to be understood that certain descriptions of the embodiments described herein have been simplified to illustrate only those elements, features, and aspects that are relevant to a clear understanding of the disclosed embodiments, while eliminating, for purposes of clarity, other elements, features, and aspects. Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention as defined solely by the claims.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

All percentages and ratios are calculated based on the total weight of the alloy composition, unless otherwise indicated.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

Conventional alloys used in chemical processing, mining, and/or oil and gas applications may lack an optimal level of corrosion resistance and/or an optimal level of one or more mechanical properties. Various embodiments of the alloys described herein may have certain advantages over conventional alloys, including, but not limited to, improved corrosion resistance and/or mechanical properties. Certain embodiments may exhibit improved mechanical properties, without any reduction in corrosion resistance, for example. Certain embodiments may exhibit improved impact properties, weldability, resistant to corrosion fatigue, galling and/or hydrogen embrittlement relative to conventional alloys.

In various embodiments, the alloys described herein may have substantial corrosion resistance and/or advantageous mechanical properties suitable for use in demanding applications. Without wishing to be bound to any particular theory, it is believed that the alloys described herein may exhibit higher tensile strength due to an improved response to strain hardening from deformation, while also retaining high corrosion resistance. Strain hardening or cold working may be used to harden materials that do not generally respond well to heat treatment. A person skilled in the art, however, will appreciate that the exact nature of the cold worked structure may depend on the material, the strain, strain rate, and/or temperature of deformation. Without wishing to be bound to any particular theory, it is believed that strain hardening an alloy having the composition described herein may more efficiently produce an alloy exhibiting improved corrosion resistance and/or mechanical properties than certain conventional alloys.

According to various non-limiting embodiments, an austenitic alloy according to the present disclosure may comprise, consist essentially of, or consist of, chromium, cobalt, copper, iron, manganese, molybdenum, nickel, carbon, nitrogen, and tungsten, and may, but need not, include one or more of aluminum, silicon, titanium, boron, phosphorus, sulfur, niobium (i.e., columbium), tantalum, ruthenium, vanadium, and zirconium, either as trace elements or incidental impurities.

Also, according to various embodiments, an austenitic alloy according to the present disclosure may comprise, consist essentially of, or consist of, in weight percentages based on total alloy weight, up to 0.2 carbon, up to 20 manganese, 0.1 to 1.0 silicon, 14.0 to 28.0 chromium, 15.0 to 38.0 nickel, 2.0 to 9.0 molybdenum, 0.1 to 3.0 copper, 0.08 to 0.9 nitrogen, 0.1 to 5.0 tungsten, 0.5 to 5.0 cobalt, up to 1.0 titanium, up to 0.05 boron, up to 0.05 phosphorus, up to 0.05 sulfur, iron, and incidental impurities.

In addition, according to various non-limiting embodiments, an austenitic alloy according to the present disclosure may comprise, consist essentially of, or consist of, in weight percentages based on total alloy weight, up to 0.05 carbon, 1.0 to 9.0 manganese, 0.1 to 1.0 silicon, 18.0 to 26.0 chromium, 19.0 to 37.0 nickel, 3.0 to 7.0 molybdenum, 0.4 to 2.5 copper, 0.1 to 0.55 nitrogen, 0.2 to 3.0 tungsten, 0.8 to 3.5 cobalt, up to 0.6 titanium, a combined weight percentage of columbium and tantalum no greater than 0.3, up to 0.2 vanadium, up to 0.1 aluminum, up to 0.05 boron, up to 0.05 phosphorus, up to 0.05 sulfur, iron, and incidental impurities.

Also, according to various non-limiting embodiments, an austenitic alloy according to the present disclosure may comprise, consist essentially of, or consist of, in weight percentages based on total alloy weight, up to 0.05 carbon, 2.0 to 8.0 manganese, 0.1 to 0.5 silicon, 19.0 to 25.0 chromium, 20.0 to 35.0 nickel, 3.0 to 6.5 molybdenum, 0.5 to 2.0 copper, 0.2 to 0.5 nitrogen, 0.3 to 2.5 tungsten, 1.0 to 3.5 cobalt, up to 0.6 titanium, a combined weight percentage of columbium and tantalum no greater than 0.3, up to 0.2 vanadium, up to 0.1 aluminum, up to 0.05 boron, up to 0.05 phosphorus, up to 0.05 sulfur, iron, and incidental impurities.

In various non-limiting embodiments, an alloy according to the present disclosure may comprise carbon in any of the following weight percentage ranges: up to 2.0; up to 0.8; up to 0.2; up to 0.08; up to 0.05; up to 0.03; 0.005 to 2.0; 0.01 to 2.0; 0.01 to 1.0; 0.01 to 0.8; 0.01 to 0.08; 0.01 to 0.05; and 0.005 to 0.01.

In various non-limiting embodiments, an alloy according to the present disclosure may comprise manganese in any of the following weight percentage ranges: up to 20.0; up to 10.0; 1.0 to 20.0; 1.0 to 10; 1.0 to 9.0; 2.0 to 8.0; 2.0 to 7.0; 2.0 to 6.0; 3.5 to 6.5; and 4.0 to 6.0.

In various non-limiting embodiments, an alloy according to the present disclosure may comprise silicon in any of the following weight percentage ranges: up to 1.0; 0.1 to 1.0; 0.5 to 1.0; and 0.1 to 0.5.

In various non-limiting embodiments, an alloy according to the present disclosure may comprise chromium in any of the following weight percentage ranges: 14.0 to 28.0; 16.0 to 25.0; 18.0 to 26; 19.0 to 25.0; 20.0 to 24.0; 20.0 to 22.0; 21.0 to 23.0; and 17.0 to 21.0.

In various non-limiting embodiments, an alloy according to the present disclosure may comprise nickel in any of the following weight percentage ranges: 15.0 to 38.0; 19.0 to 37.0; 20.0 to 35.0; and 21.0 to 32.0.

In various non-limiting embodiments, an alloy according to the present disclosure may comprise molybdenum in any of the following weight percentage ranges: 2.0 to 9.0; 3.0 to 7.0; 3.0 to 6.5; 5.5 to 6.5; and 6.0 to 6.5.

In various non-limiting embodiments, an alloy according to the present disclosure may comprise copper in any of the following weight percentage ranges: 0.1 to 3.0; 0.4 to 2.5; 0.5 to 2.0; and 1.0 to 1.5.

In various non-limiting embodiments, an alloy according to the present disclosure may comprise nitrogen in any of the following weight percentage ranges: 0.08 to 0.9; 0.08 to 0.3; 0.1 to 0.55; 0.2 to 0.5; and 0.2 to 0.3. In certain embodiments, nitrogen may be limited to 0.35 weight percent or 0.3 weight percent to address its limited solubility in the alloy.

In various non-limiting embodiments, an alloy according to the present disclosure may comprise tungsten in any of the following weight percentage ranges: 0.1 to 5.0; 0.1 to 1.0; 0.2 to 3.0; 0.2 to 0.8; and 0.3 to 2.5.

In various non-limiting embodiments, an alloy according to the present disclosure may comprise cobalt in any of the following weight percentage ranges: up to 5.0; 0.5 to 5.0; 0.5 to 1.0; 0.8 to 3.5; 1.0 to 4.0; 1.0 to 3.5; and 1.0 to 3.0. In certain embodiments, cobalt unexpectedly improved mechanical properties of the alloy. For example, in certain embodiments of the alloy, additions of cobalt may provide up to a 20% increase in toughness, up to a 20% increase in elongation, and/or improved corrosion resistance. Without wishing to be bound to any particular theory, it is believed that cobalt may increase the resistance to detrimental sigma phase precipitation in the alloy relative to non-cobalt bearing variants which exhibited higher levels of sigma phase at the grain boundaries after hot working.

In various non-limiting embodiments, an alloy according to the present disclosure may comprise a cobalt/tungsten weight percentage ratio of from 2:1 to 5:1, or from 2:1 to 4:1. In certain embodiments, for example, the cobalt/tungsten weight percentage ratio may be about 4:1. The use of cobalt and tungsten may impart improved solid solution strengthening to the alloy.

In various non-limiting embodiments, an alloy according to the present disclosure may comprise titanium in any of the following weight percentage ranges: up to 1.0; up to 0.6; up to 0.1; up to 0.01; 0.005 to 1.0; and 0.1 to 0.6.

In various non-limiting embodiments, an alloy according to the present disclosure may comprise zirconium in any of the following weight percentage ranges: up to 1.0; up to 0.6; up to 0.1; up to 0.01; 0.005 to 1.0; and 0.1 to 0.6.

In various non-limiting embodiments, an alloy according to the present disclosure may comprise columbium (niobium) and/or tantalum in any of the following weight percentage ranges: up to 1.0; up to 0.5; up to 0.3; 0.01 to 1.0; 0.01 to 0.5; 0.01 to 0.1; and 0.1 to 0.5. In various non-limiting embodiments, an alloy according to the present disclosure may comprise a combined weight percentage of columbium and tantalum in any of the following ranges: up to 1.0; up to 0.5; up to 0.3; 0.01 to 1.0; 0.01 to 0.5; 0.01 to 0.1; and 0.1 to 0.5.

In various non-limiting embodiments, an alloy according to the present disclosure may comprise vanadium in any of the following weight percentage ranges: up to 1.0; up to 0.5; up to 0.2; 0.01 to 1.0; 0.01 to 0.5; 0.05 to 0.2; and 0.1 to 0.5.

In various non-limiting embodiments, an alloy according to the present disclosure may comprise aluminum in any of the following weight percentage ranges: up to 1.0; up to 0.5; up to 0.1; up to 0.01; 0.01 to 1.0; 0.1 to 0.5; and 0.05 to 0.1.

In various non-limiting embodiments, an alloy according to the present disclosure may comprise boron in any of the following weight percentage ranges: up to 0.05; up to 0.01; up to 0.008; up to 0.001; up to 0.0005.

In various non-limiting embodiments, an alloy according to the present disclosure may comprise phosphorus in any of the following weight percentage ranges: up to 0.05; up to 0.025; up to 0.01; and up to 0.005.

In various non-limiting embodiments, an alloy according to the present disclosure may comprise sulfur in any of the following weight percentage ranges: up to 0.05; up to 0.025; up to 0.01; and up to 0.005.

In various non-limiting embodiments, the balance of an alloy according to the present disclosure may comprise iron and incidental impurities. In various embodiments, the alloy may comprise iron in any of the following weight percentage ranges: up to 60; up to 50; 20 to 60; 20 to 50; 20 to 45; 35 to 45; 30 to 50; 40 to 60; 40 to 50; 40 to 45; and 50 to 60.

In certain non-limiting embodiments of an alloy according to the present disclosure, the alloy may include one or more trace elements. As used herein, "trace elements" refers to elements that may be present in the alloy as a result of the composition of the raw materials and/or the melt method employed and which are not present in concentrations that do not significantly negatively affect important properties of the alloy, as those properties are generally described herein. Trace elements may include, for example, one or more of titanium, zirconium, columbium (niobium), tantalum, vanadium, aluminum, and boron in any of the concentrations described herein. In certain non-limiting embodiments, trace elements may not be present in alloys according to the present disclosure. As is known in the art, in producing alloys, trace elements typically may be largely or wholly eliminated by selection of particular starting materials and/or use of particular processing techniques. In various non-limiting embodiments, an alloy according to the present disclosure may comprise a total concentration of trace elements in any of the following weight percentage ranges: up to 5.0; up to 1.0; up to 0.5; up to 0.1; 0.1 to 5.0; 0.1 to 1.0; and 0.1 to 0.5.

In various non-limiting embodiments, an alloy according to the present disclosure may comprise a total concentration of incidental impurities in any of the following weight percentage ranges: up to 5.0; up to 1.0; up to 0.5; up to 0.1; 0.1 to 5.0; 0.1 to 1.0; and 0.1 to 0.5. As generally used herein, the term "incidental impurities" refers to one or more of bismuth, calcium, cerium, lanthanum, lead, oxygen, phosphorus, ruthenium, silver, selenium, sulfur, tellurium, tin and zirconium, which may be present in the alloy in minor concentrations. In various non-limiting embodiments, individual incidental impurities in an alloy according to the present disclosure do not exceed the following maximum weight percentages: 0.0005 bismuth; 0.1 calcium; 0.1 cerium; 0.1 lanthanum; 0.001 lead; 0.01 tin, 0.01 oxygen; 0.5 ruthenium; 0.0005 silver; 0.0005 selenium; and 0.0005 tellurium. In various non-limiting embodiments, the combined weight percentage of any cerium and/or lanthanum and calcium present in the alloy may be up to 0.1. In various non-limiting embodiments, the combined weight percentage of any cerium and/or lanthanum present in the alloy may be up to 0.1. Other elements that may be present as incidental impurities in the alloys described herein will be apparent to those having ordinary skill in the art. In various non-limiting embodiments, an alloy according to the present disclosure may include a total concentration of trace elements and incidental impurities in any of the following weight percentage ranges: up to 10.0; up to 5.0; up to 1.0; up to 0.5; up to 0.1; 0.1 to 10.0; 0.1 to 5.0; 0.1 to 1.0; and 0.1 to 0.5.

In various non-limiting embodiments, an austenitic alloy according to the present disclosure may be non-magnetic. This characteristic may facilitate use of the alloy in which non-magnetic properties are important including, for example, use in certain oil and gas drill string component applications. Certain non-limiting embodiments of the austenitic alloy described herein may be characterized by a magnetic permeability value ($\mu_r$) within a particular range. In various embodiments, the magnetic permeability value of an alloy according to the present disclosure may be less than 1.01, less than 1.005, and/or less than 1.001. In various embodiments, the alloy may be substantially free from ferrite.

In various non-limiting embodiments, an austenitic alloy according to the present disclosure may be characterized by a pitting resistance equivalence number (PREN) within a particular range. As is understood, the PREN ascribes a relative value to an alloy's expected resistance to pitting corrosion in a chloride-containing environment. Generally, alloys having a higher PREN are expected to have better corrosion resistance than alloys having a lower PREN. One particular PREN calculation provides a $PREN_{16}$ value using the following formula, wherein the percentages are weight percentages based on alloy weight:

$$PREN_{16}=\%\,Cr+3.3(\%\,Mo)+16(\%\,N)+1.65(\%\,W)$$

In various non-limiting embodiments, an alloy according to the present disclosure may have a $PREN_{16}$ value in any of the following ranges: up to 60; up to 58; greater than 30; greater than 40; greater than 45; greater than 48; 30 to 60; 30 to 58; 30 to 50; 40 to 60; 40 to 58; 40 to 50; and 48 to 51. Without wishing to be bound to any particular theory, it is believed that a higher $PREN_{16}$ value may indicate a higher likelihood that the alloy will exhibit sufficient corrosion resistance in environments such as, for example, highly corrosive environments, high temperature environments, and low temperature environments. Aggressively corrosive environments may exist in, for example, chemical processing equipment and the down-hole environment to which a drill string is subjected in oil and gas drilling applications. Aggressively corrosive environments may subject an alloy to, for example, alkaline compounds, acidified chloride solutions, acidified sulfide solutions, peroxides, and/or $CO_2$, along with extreme temperatures.

In various non-limiting embodiments, an austenitic alloy according to the present disclosure may be characterized by a coefficient of sensitivity to avoid precipitations value (CP) within a particular range. The CP value is described in, for example, U.S. Pat. No. 5,494,636, entitled "Austenitic Stainless Steel Having High Properties". The CP value is a relative indication of the kinetics of precipitation of intermetallic phases in an alloy. A CP value may be calculated using the following formula, wherein the percentages are weight percentages based on alloy weight:

$$CP=20(\%\ Cr)+0.3(\%\ Ni)+30(\%\ Mo)+5(\%\ W)+10(\%\ Mn)+50(\%\ C)-200(\%\ N)$$

Without wishing to be bound to any particular theory, it is believed that alloys having a CP value less than 710 will exhibit advantageous austenite stability which helps to minimize HAZ (heat affected zone) sensitization from intermetallic phases during welding. In various non-limiting embodiments, an alloy described herein may have a CP in any of the following ranges: up to 800; up to 750; less than 750; up to 710; less than 710; up to 680; and 660-750.

In various non-limiting embodiments, an austenitic alloy according to the present disclosure may be characterized by a Critical Pitting Temperature (CPT) and/or a Critical Crevice Corrosion Temperature (CCCT) within particular ranges. In certain applications, CPT and CCCT values may more accurately indicate corrosion resistance of an alloy than the alloy's PREN value. CPT and CCCT may be measured according to ASTM G48-11, entitled "Standard Test Methods for Pitting and Crevice Corrosion Resistance of Stainless Steels and Related Alloys by Use of Ferric Chloride Solution". In various non-limiting embodiments, the CPT of an alloy according to the present disclosure may be at least 45° C., or more preferably is at least 50° C., and the CCCT may be at least 25° C., or more preferably is at least 30° C.

In various non-limiting embodiments, an austenitic alloy according to the present disclosure may be characterized by a Chloride Stress Corrosion Cracking Resistance (SCC) value within a particular range. The SCC value is described in, for example, A. J. Sedricks, "Corrosion of Stainless Steels" (J. Wiley and Sons 1979). In various non-limiting embodiments, the SCC value of an alloy according to the present disclosure may be measured or particular applications according to one or more of ASTM G30-97 (2009), entitled "Standard Practice for Making and Using U-Bend Stress-Corrosion Test Specimens"; ASTM G36-94 (2006), entitled "Standard Practice for Evaluating Stress-Corrosion-Cracking Resistance of Metals and Alloys in a Boiling Magnesium Chloride Solution"; ASTM G39-99 (2011), "Standard Practice for Preparation and Use of Bent-Beam Stress-Corrosion Test Specimens"; ASTM G49-85 (2011), "Standard Practice for Preparation and Use of Direct Tension Stress-Corrosion Test Specimens"; and ASTM G123-00 (2011), "Standard Test Method for Evaluating Stress-Corrosion Cracking of Stainless Alloys with Different Nickel Content in Boiling Acidified Sodium Chloride Solution." In various non-limiting embodiments, the SCC value of an alloy according to the present disclosure is high enough to indicate that the alloy can suitably withstand boiling acidified sodium chloride solution for 1000 hours without experiencing unacceptable stress corrosion cracking, pursuant to evaluation under ASTM G123-00 (2011).

The alloys described herein may be fabricated into or included in various articles of manufacture. Such articles of manufacture may comprise, for example and without limitation, an austenitic alloy according to the present disclosure comprising, consisting essentially of, or consisting of, in weight percentages based on total alloy weight: up to 0.2 carbon; up to 20 manganese; 0.1 to 1.0 silicon; 14.0 to 28.0 chromium; 15.0 to 38.0 nickel; 2.0 to 9.0 molybdenum; 0.1 to 3.0 copper; 0.08 to 0.9 nitrogen; 0.1 to 5.0 tungsten; 0.5 to 5.0 cobalt; up to 1.0 titanium; up to 0.05 boron; up to 0.05 phosphorus; up to 0.05 sulfur; iron; and incidental impurities. Articles of manufacture that may include an alloy according to the present disclosure may be selected from, for example, parts and components for use in the chemical industry, petrochemical industry, mining industry, oil industry, gas industry, paper industry, food processing industry, pharmaceutical industry, and/or water service industry. Non-limiting examples of specific articles of manufacture that may include an alloy according to the present disclosure include: a pipe; a sheet; a plate; a bar; a rod; a forging; a tank; a pipeline component; piping, condensers, and heat exchangers intended for use with chemicals, gas, crude oil, seawater, service water, and/or corrosive fluids (e.g., alkaline compounds, acidified chloride solutions, acidified sulfide solutions, and/or peroxides); filter washers, vats, and press rolls in pulp bleaching plants; service water piping systems for nuclear power plants and power plant flue gas scrubber environments; components for process systems for offshore oil and gas platforms; gas well components, including tubes, valves, hangers, landing nipples, tool joints and packers; turbine engine components; desalination components and pumps; tall oil distillation columns and packing; articles for marine environments, such as, for example, transformer cases; valves; shafting; flanges; reactors; collectors; separators; exchangers; pumps; compressors; fasteners; flexible connectors; bellows; chimney liners; flue liners; and certain drill string components such as, for example, stabilizers, rotary steerable drilling components, drill collars, integral blade stabilizers, stabilizer mandrels, drilling and measurement tubulars, measurements-while-drilling housings, logging-while-drilling housings, non-magnetic drill collars, non-magnetic drill pipe, integral blade non-magnetic stabilizers, non-magnetic flex collars, and compressive service drill pipe.

Alloys according to the present disclosure may be made according to techniques known to those having ordinary skill upon reviewing the composition of the alloy described in the present disclosure. For example, a method for producing an austenitic alloy according to the present disclosure may generally comprise: providing an austenitic alloy having any of the compositions described in the present disclosure; and strain hardening the alloy. In various non-limiting embodiments of the method, the austenitic alloy comprises, consists essentially of, or consist of, in weight percentages: up to 0.2 carbon; up to 20 manganese; 0.1 to 1.0 silicon; 14.0 to 28.0 chromium; 15.0 to 38.0 nickel; 2.0 to 9.0 molybdenum; 0.1 to 3.0 copper; 0.08 to 0.9 nitrogen; 0.1 to 5.0 tungsten; 0.5 to 5.0 cobalt; up to 1.0 titanium; up to 0.05 boron; up to 0.05 phosphorus; up to 0.05 sulfur; iron; and incidental impurities. In various non-limiting embodiments of such a method, strain hardening the alloy may be conducted in a conventional manner by deforming the alloy using one or more of rolling, forging, piercing, extruding, shot blasting, peening, and/or bending the alloy. In various non-limiting embodiments, strain hardening may comprise cold working the alloy.

The step of providing an austenitic alloy having any of the compositions described in the present disclosure may comprise any suitable conventional technique known in the art for producing metal alloys, such as, for example, melt practices and powder metallurgy practices. Non-limiting examples of conventional melt practices include, without limitation, practices utilizing consumable melting techniques (e.g., vacuum arc remelting (VAR) and electroslag remelting (ESR)), non-consumable melting techniques (e.g., plasma cold hearth melting and electron beam cold hearth melting), and a combination of two or more of these techniques. As known in the art, certain powdered metallurgy practices for preparing an alloy generally involve producing powdered alloy by the following steps: AOD, VOD, or vacuum induction melting ingredients to provide a melt having the desired composition; atomizing the melt using a conventional atomization techniques to provide a powdered alloy; and pressing and sintering all or a portion of the powdered alloy. In one conventional atomization technique, a stream of the melt is contacted with the spinning blade of an atomizer, which breaks up the stream into small droplets. The droplets may be rapidly solidified in a vacuum or inert gas atmosphere, providing small solid alloy particles.

Whether preparing an alloy using melt or powder metallurgy practices, the ingredients used to produce the alloy (which may include, for example, pure elemental starting materials, master alloys, semi-refined materials, and/or scrap) may be combined in a conventional manner in desired amounts and ratios, and introduced into the selected melting apparatus. Through appropriate selection of feed materials, trace elements and/or incidental impurities may be held to acceptable levels to obtain desired mechanical or other properties in the final alloy. The selection and manner of addition of each of the raw ingredients to form the melt may be carefully controlled because of the effect these additions have on the properties of the alloy in the finished form. Also, refining techniques known in the art may be applied to reduce or eliminate the presence of undesirable elements and/or inclusions in the alloy. When melted, the materials may be consolidated into a generally homogenous form via conventional melting and processing techniques.

Various embodiments of the austenitic steel alloy described herein may have improved corrosion resistance and/or mechanical properties relative to conventional alloys. Certain of the alloy embodiments may have ultimate tensile strength, yield strength, percent elongation, and/or hardness greater comparable to or better than DATALLOY 2® alloy and/or AL-6XN® alloy. Also, certain of the alloy embodiments may have a PREN, CP, CPT, CCCT, and/or SCC values comparable to or greater than DATALLOY 2® alloy and/or AL-6XN® alloy. In addition, certain of the alloy embodiments may have improved fatigue strength, microstructural stability, toughness, thermal cracking resistance, pitting corrosion, galvanic corrosion, SCC, machinability, and/or galling resistance relative to DATALLOY 2® alloy and/or AL-6XN® alloy. As known to those having ordinary skill in the art, DATALLOY 2® alloy is a Cr—Mn—N stainless steel having the following nominal composition, in weight percentages: 0.03 carbon; 0.30 silicon; 15.1 manganese; 15.3 chromium; 2.1 molybdenum; 2.3 nickel; 0.4 nitrogen; balance iron and impurities. As also known to those having ordinary skill in the art, AL-6XN® alloy (UNS N08367) is a superaustenitic stainless steel having the following typical composition, in weight percentages: 0.02 carbon; 0.40 manganese; 0.020 phosphorus; 0.001 sulfur; 20.5 chromium; 24.0 nickel; 6.2 molybdenum; 0.22 nitrogen; 0.2 copper; balance iron. DATALLOY 2® alloy and AL-6XN® alloy are available from Allegheny Technologies Incorporated, Pittsburgh, Pa. USA.

In certain non-limiting embodiments, an alloy according to the present disclosure exhibits, at room temperature, ultimate tensile strength of at least 110 ksi, yield strength of at least 50 ksi, and/or percent elongation of at least 15%. In various other non-limiting embodiments, an alloy according to the present disclosure, in an annealed state, exhibits, at room temperature, ultimate tensile strength in the range of 90 ksi to 150 ksi, yield strength in the range of 50 ksi to 120 ksi, and/or percent elongation in the range of 20% to 65%. In various non-limiting embodiments, after strain hardening the alloy, the alloy exhibits an ultimate tensile strength of at least 155 ksi, a yield strength of at least 100 ksi, and/or a percent elongation of at least 15%. In certain other non-limiting embodiments, after strain hardening the alloy, the alloy exhibits an ultimate tensile in the range of 100 ksi to 240 ksi, a yield strength in the range of 110 ksi to 220 ksi, and/or a percent elongation in the range of 15% to 30%. In other non-limiting embodiments, after strain hardening an alloy according to the present disclosure, the alloy exhibits a yield strength up to 250 ksi and/or an ultimate tensile strength up to 300 ksi.

EXAMPLES

The various embodiments described herein may be better understood when read in conjunction with one or more of the following representative examples. The following examples are included for purposes of illustration and not limitation.

Several 300 pound heats were prepared by VIM having the compositions listed in Table 1, wherein blanks indicate that no value was determined for the element. Heat Numbers WT-76 to WT-81 represent non-limiting embodiments of alloys according to the present disclosure. Heat Numbers WT-82, 90FE-T1, and 90FE-B1 represent embodiments of DATALLOY 2® alloy. Heat Number WT-83 represents an embodiment of AL-6XN® alloy. The heats were cast into ingots, and samples of the ingots were used to establish a suitable working range for ingot break-down. Ingots were forged at 2150° F. with suitable reheats to obtain 2.75 inch by 1.75 inch rectangular bars from each heat.

Sections about 6 inches long were taken from the rectangular bars produced from several of the heats and forged to about a 20% to 35% reduction to strain harden the sections. The strain hardened sections were tensile tested to determine mechanical properties, which are listed in Table 2. Tensile and magnetic permeability testing were conducted using standard tensile test procedures. Corrosion resistance of each section was evaluated using the procedure of Practice C of ASTM G48-11, "Standard Test Methods for Pitting and Crevice Corrosion Resistance of Stainless Steels and Related Alloys by Use of Ferric Chloride Solution". Corrosion resistance also was estimated using the $PREN_{16}$ formula provided above. Table 2 provides the temperature at which the sections were forged. As indicated in Table 2, duplicate tests were conducted on each of the samples. Table 2 also lists the percent reduction in thickness ("deformation %") of the sections achieved in the forging step for each section. Each of the tested sections initially was evaluated for mechanical properties at room temperature ("RT") prior to forging (0% deformation).

As shown in Table 1, Heat Numbers WT-76 to WT-81 had higher $PREN_{16}$ values and CP values relative to Heat Number WT-82, and improved CP values relative to Heat Numbers 90FE-T1 and 90FE-B1. Referring to Table 2, the ductility of the cobalt-containing alloys produced in Heat Numbers WT-80 and WT-81 unexpectedly was significantly better than the measured ductility of the alloys produced in Heat Numbers WT-76 and WT-77, which are generally corresponding alloys lacking cobalt. This observation suggests that there is an advantage to including cobalt in alloys of the present disclosure. As discussed above, without wishing to be bound to any particular theory, it is believed that cobalt may increase the resistance to detrimental sigma phase precipitation in the alloy, thereby improving ductility. The data in Table 2 also indicates that the addition of manganese to Heat Number WT-83 increased strength after deformation. All of the experimental alloys were non-magnetic (having a magnetic permeability of about 1.001) when evaluated using the test procedure conventionally used to measure magnetic permeability of DATALLOY 2® alloy.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth herein. Such embodiments may be obtained, for example, by combining, modifying, or reorganizing any of the disclosed steps, components, elements, features, aspects, characteristics, limitations, and the like, of the various non-limiting embodiments described in this specification. In this manner, Applicants reserve the right to amend the claims during prosecution to add features as variously described in this specification, and such amendments comply with the requirements of 35 U.S.C. §112, first paragraph, and 35 U.S.C. §132(a).

TABLE 2

| Heat No | Temp (° F.) | Deformation (%) | UTS (ksi) | YS (ksi) | EI (%) | RA (%) |
|---|---|---|---|---|---|---|
| WT-76 | RT | 0 | 135.0 | 66.3 | 39 | 40 |
| | | | 138.6 | 71.8 | 37 | 40 |
| | 1200 | 20 | 183.9 | 158.4 | 16 | 33 |
| | | | 178.7 | 153.2 | 16 | 35 |
| | 1075 | 21 | 185.3 | 160.5 | 12 | 32 |
| | | | 185.7 | 160.5 | 14 | 33 |
| | | 24 | 183.0 | 157.1 | 14 | 31 |
| | | | 188.9 | 164.8 | 15 | 31 |
| WT-77 | RT | 0 | 117.4 | 52.2 | 55 | 61 |
| | | | 116.5 | 52.6 | 56 | 61 |
| | 1200 | 26 | 164.9 | 140.1 | 23 | 49 |
| | | | 162.3 | 38.3 | 23 | 52 |
| | 1075 | 29 | 162.3 | 137.1 | 23 | 56 |
| | | | 164.6 | 139.8 | 21 | 53 |
| | | 30 | 165.9 | 141.6 | 20 | 53 |
| | | | 169.7 | 144.4 | 18 | 45 |
| WT-80 | RT | 0 | 119.9 | 58.4 | 56 | 68 |
| | | | 119.5 | 57.9 | 56 | 72 |
| | 1200 | 26 | 164.8 | 140.2 | 25 | 61 |
| | | | 165.3 | 139.8 | 23 | 55 |
| | 1075 | 29 | 165.2 | 141.8 | 20 | 55 |
| | | | 166.1 | 143.9 | 20 | 53 |
| | | 28 | 165.6 | 142.2 | 23 | 60 |
| | | | 168.1 | 145.2 | 21 | 53 |
| WT-81 | RT | 0 | 116.9 | 53.7 | 62 | 74 |
| | | | 117.4 | 53.4 | 64 | 72 |
| | 1200 | 25 | 157.9 | 133.3 | 29 | 68 |
| | | | 162.2 | 136.9 | 27 | 65 |
| | 1075 | 31 | 68.3 | 144.3 | 24 | 63 |
| | | | 164.0 | 139.2 | 26 | 67 |
| | | 30 | 168.5 | 145.2 | 25 | 60 |
| | | | 168.1 | 143.6 | 25 | 64 |
| WT-82 | RT | 0 | 110.0 | 56.4 | 69 | 78 |
| | | | 109.2 | 54.2 | 68 | 76 |
| | 1200 | 24 | 144.5 | 120.5 | 36 | 69 |

TABLE 1

| Element | Heat WT-76 | Heat WT-77 | Heat WT-78 | Heat WT-79 | Heat WT-80 | Heat WT-81 | Heat WT-82 | Heat WT-83 | Heat 90FE-T1 | Heat 90FE-B1 |
|---|---|---|---|---|---|---|---|---|---|---|
| C | 0.012 | 0.011 | 0.011 | 0.011 | 0.007 | 0.012 | 0.020 | 0.016 | 0.028 | 0.280 |
| Mn | 5.75 | 3.94 | 4.04 | 2.00 | 6.09 | 4.05 | 14.94 | 0.61 | 14.97 | 14.92 |
| Si | 0.33 | 0.31 | 0.03 | 0.32 | 0.23 | 0.30 | 0.15 | 0.32 | 0.16 | 0.16 |
| Cr | 22.78 | 22.37 | 22.83 | 22.99 | 20.32 | 21.98 | 14.96 | 21.38 | 15.03 | 14.98 |
| Mo | 6.38 | 6.46 | 6.36 | 6.30 | 6.64 | 6.45 | 2.17 | 6.63 | 2.10 | 2.10 |
| Co | 0.04 | 0.04 | 0.04 | 0.04 | 2.03 | 2.00 | <0.01 | 0.05 | 0.02 | 0.02 |
| Ti | 0.01 | <0.01 | <0.01 | <0.01 | <0.01 | <0.01 | <0.01 | <0.01 | <0.01 | <0.01 |
| Al | <0.01 | <0.01 | <0.01 | 0.01 | <0.01 | <0.01 | <0.01 | <0.01 | <0.01 | <0.01 |
| Fe | 41.27 | 41.33 | 40.87 | 40.70 | 42.32 | 41.44 | 65.28 | 45.30 | 65.22 | 65.32 |
| Cu | 1.20 | 1.19 | 1.17 | 1.17 | 1.16 | 1.19 | 0.02 | 0.20 | 0.1 | 0.1 |
| Ni | 21.63 | 24.07 | 23.92 | 26.09 | 20.72 | 21.20 | 2.43 | 25.34 | 2.28 | 2.28 |
| Nb | 0.01 | 0.01 | 0.02 | 0.02 | 0.02 | 0.01 | <0.01 | 0.01 | 0.03 | 0.03 |
| Ta | <0.01 | <0.01 | <0.01 | <0.01 | <0.01 | <0.01 | | 0.01 | | |
| W | 0.63 | 0.65 | 0.62 | 0.64 | 0.60 | 0.63 | 0.02 | 0.10 | <0.01 | <0.01 |
| V | 0.05 | 0.05 | 0.05 | 0.05 | 0.05 | 0.05 | <0.01 | 0.04 | 0.05 | 0.05 |
| B | <0.001 | <0.001 | <0.001 | <0.001 | <0.001 | | 0.00 | 0.0013 | 0.003 | <0.001 |
| N | 0.312 | 0.296 | 0.326 | 0.284 | 0.322 | 0.338 | 0.396 | 0.218 | 0.404 | 0.420 |
| P | 0.006 | 0.005 | 0.005 | 0.005 | 0.004 | 0.004 | 0.003 | 0.004 | 0.018 | 0.018 |
| Zr | <0.01 | <0.01 | <0.01 | <0.01 | <0.01 | <0.01 | | | | |
| O | 0.0087 | | | | | | | | | |
| Ca | <10 ppm | <10 ppm | <10 ppm | <10 ppm | <10 ppm | | | | | |
| S | 0.0048 | 0.0048 | 0.0053 | 0.0022 | 0.0028 | 0.0060 | 0.0096 | 0.0024 | 0.0003 | <0.0003 |
| La | | | | | | | | | | |
| Ru | | | | | | | | | | |
| $PREN_{16}$ | 50 | 50 | 50 | 49 | 48 | 50 | 28 | 47 | | |
| CP | 726 | 706 | 698 | 696 | 685 | 690 | 462 | 674 | | |

TABLE 2-continued

| Heat No | Temp (° F.) | Deformation (%) | UTS (ksi) | YS (ksi) | EI (%) | RA (%) |
|---|---|---|---|---|---|---|
| | | | 142.8 | 118.5 | 37 | 69 |
| | 1075 | 30 | 147.1 | 123.8 | 35 | 69 |
| | | | 144.8 | 122.4 | 36 | 71 |
| | | 35 | 149.0 | 126.4 | 35 | 66 |
| | | | 147.9 | 123.2 | 36 | 70 |
| 90FE | RT | 0 | 113.2 | 59.6 | 66 | 75 |
| | | | 112.9 | 60.3 | 67 | 78 |
| | 1200 | 26 | 152.3 | 130.1 | 36 | 71 |
| | | | 150.7 | 126.4 | 37 | 72 |
| | 1075 | 30 | 154.3 | 131.9 | 32 | 71 |
| | | 35 | 154.0 | 131.5 | 34 | 71 |
| | | | 154.6 | 133.0 | 33 | 71 |
| WT-83 | RT | 0 | 112.8 | 49.6 | 56 | 73 |
| | | | 112.2 | 48.9 | 59 | 77 |
| | 1200 | 27 | 153.0 | 131.1 | 27 | 69 |
| | | | 153.5 | 130.9 | 26 | 67 |
| | 1075 | 31 | 152.8 | 130.5 | 23 | 71 |
| | | 23 | 150.8 | 127.1 | 23 | 70 |
| | | | 150.8 | 127.7 | 23 | 70 |

What is claimed is:

1. An austenitic alloy comprising, in weight percentages:
up to 0.2 carbon;
3.5 to 10.0 manganese;
0.1 to 1.0 silicon;
14.0 to 28.0 chromium;
15.0 to 38.0 nickel;
2.0 to 9.0 molybdenum;
0.1 to 3.0 copper;
0.08 to 0.9 nitrogen;
0.1 to 5.0 tungsten;
0.5 to 5.0 cobalt;
up to 1.0 titanium;
up to 0.05 boron;
up to 0.05 phosphorus;
up to 0.05 sulfur;
iron; and
incidental impurities.

2. The alloy of claim 1 further comprising at least one of columbium and tantalum, wherein a combined weight percentage of columbium and tantalum is up to 0.3.

3. The alloy of claim 1 further comprising up to 0.2 weight percent vanadium.

4. The alloy of claim 1 further comprising up to 0.1 weight percent aluminum.

5. The alloy of claim 1 further comprising at least one of cerium and lanthanum, wherein a combined weight percentage of cerium and lanthanum is no greater than 0.1.

6. The alloy of claim 1 further comprising up to 0.5 weight percent ruthenium.

7. The alloy of claim 1 further comprising up to 0.6 weight percent zirconium.

8. The alloy of claim 1, wherein the iron is up to 60 weight percent.

9. The alloy of claim 1 comprising a cobalt/tungsten ratio, based on weight percentages, from 2:1 to 4:1.

10. The alloy of claim 1 having a PRE $N_{16}$ value of greater than 40.

11. The alloy of claim 1 having a PRE $N_{16}$ value from 40 to 60.

12. The alloy of claim 1, wherein the alloy is non-magnetic.

13. The alloy of claim 1 having a magnetic permeability value of less than 1.01.

14. The alloy of claim 1 having an ultimate tensile strength of at least 110 ksi, a yield strength of at least 50 ksi, and a percent elongation of at least 15%.

15. The alloy of claim 1 having an ultimate tensile strength in the range of 90 ksi to 150 ksi, a yield strength in the range of 50 ksi to 120 ksi, and a percent elongation in the range of 20% to 65%.

16. The alloy of claim 1 having an ultimate tensile strength in the range of 100 ksi to 240 ksi, a yield strength in the range of 110 ksi to 220 ksi, and a percent elongation in the range of 15% to 30%.

17. The alloy of claim 1 having a critical pitting temperature of at least 45° C.

18. The alloy of claim 1 comprising, in weight percentages based on total alloy weight:
up to 0.05 carbon;
3.5 to 10.0 manganese;
0.1 to 1.0 silicon;
18.0 to 26.0 chromium;
19.0 to 37.0 nickel;
3.0 to 7.0 molybdenum;
4 to 2.5 copper;
0.1 to 0.55 nitrogen;
0.2 to 3.0 tungsten;
0.8 to 3.5 cobalt;
up to 0.6 titanium;
a combined weight percentage of columbium and tantalum no greater than 0.3;
up to 0.2 vanadium;
up to 0.1 aluminum;
up to 0.05 boron;
up to 0.05 phosphorus;
up to 0.05 sulfur;
iron; and
incidental impurities.

19. The alloy of claim 18, wherein the manganese is 3.5 to 8.0 weight percent.

20. The alloy of claim 18, wherein the chromium is 19.0 to 25.0 weight percent.

21. The alloy of claim 18, wherein the nickel is 20.0 to 35.0 weight percent.

22. The alloy of claim 18, wherein the molybdenum is 3.0 to 6.5 weight percent.

23. The alloy of claim 18, wherein the copper is 0.5 to 2.0 weight percent.

24. The alloy of claim 18, wherein the tungsten is 0.3 to 2.5 weight percent.

25. The alloy of claim 18, wherein the cobalt is 1.0 to 3.5 weight percent.

26. The alloy of claim 18, wherein the iron is 20 to 50 weight percent.

27. The alloy of claim 1 comprising, in weight percentages based on total alloy weight:
up to 0.05 carbon;
3.5 to 8.0 manganese;
0.1 to 0.5 silicon;
19.0 to 25.0 chromium;
20.0 to 35.0 nickel;
3.0 to 6.5 molybdenum;
0.5 to 2.0 copper;
0.2 to 0.5 nitrogen;
0.3 to 2.5 tungsten;
1.0 to 3.5 cobalt;
up to 0.6 titanium;
a combined weight percentage of columbium and tantalum no greater than 0.3;
up to 0.2 vanadium;
up to 0.1 aluminum;
up to 0.05 boron;
up to 0.05 phosphorus;

up to 0.05 sulfur;
iron;
trace elements; and
incidental impurities.

28. The alloy of claim 27, wherein the manganese is 4.0 to 6.0.

29. The alloy of claim 27, wherein the chromium is 20.0 to 22.0 weight percent.

30. The alloy of claim 27, wherein the molybdenum is 6.0 to 6.5 weight percent.

31. The alloy of claim 27, wherein the iron is 40 to 45 weight percent.

32. The alloy of claim 1, wherein the nitrogen is 0.1 to 0.55 weight percent.

33. The alloy of claim 1, wherein the nitrogen is 0.2 to 0.5 weight percent.

34. The alloy of claim 18, wherein the nitrogen is 0.2 to 0.5 weight percent.

35. The alloy of claim 1, wherein the manganese is 3.5 to 6.5 weight percent.

36. The alloy of claim 1, wherein the manganese is 4.0 to 6.0 weight percent.

37. The alloy of claim 18, wherein the manganese is 3.5 to 6.5 weight percent.

* * * * *